US008500392B2

(12) United States Patent
Durocher et al.

(10) Patent No.: US 8,500,392 B2
(45) Date of Patent: Aug. 6, 2013

(54) SEALING FOR VANE SEGMENTS

(75) Inventors: Eric Durocher, Vercheres (CA); John Pietrobon, Outremont (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 979 days.

(21) Appl. No.: 12/572,104

(22) Filed: Oct. 1, 2009

(65) Prior Publication Data

US 2011/0081237 A1 Apr. 7, 2011

(51) Int. Cl.
*F01D 9/06* (2006.01)

(52) U.S. Cl.
USPC ..... 415/116; 415/139; 415/142

(58) Field of Classification Search
USPC ..... 415/142, 115–116, 134–139
See application file for complete search history.

(56) References Cited

U.S. PATENT DOCUMENTS 3,394,919 A 7/1968 Catterfeld
3,800,864 A * 4/1974 Hauser et al. ..... 415/115
3,807,892 A * 4/1974 Frei et al. ..... 415/116
4,126,405 A * 11/1978 Bobo et al. ..... 415/115
4,573,866 A 3/1986 Sandy, Jr. et al.
4,693,667 A * 9/1987 Lenz et al. ..... 415/115
4,859,143 A 8/1989 Larrabee et al.
4,979,872 A * 12/1990 Myers et al. ..... 415/142
5,188,506 A 2/1993 Creevy et al.
5,609,467 A * 3/1997 Lenhart et al. ..... 415/142
5,630,700 A * 5/1997 Olsen et al. ..... 415/134
5,988,975 A 11/1999 Pizzi
6,076,835 A 6/2000 Ress et al.
6,164,903 A 12/2000 Kouris
6,464,457 B1 10/2002 Morgan et al.
6,612,809 B2 9/2003 Czachor et al.
6,942,445 B2 9/2005 Morris et al.
7,207,771 B2 4/2007 Synnott et al.
7,217,089 B2 5/2007 Durocher et al.
7,261,514 B2 * 8/2007 London et al. ..... 415/134
7,338,253 B2 3/2008 Nigmatulin
7,383,686 B2 * 6/2008 Aycock et al. ..... 60/782

* cited by examiner

*Primary Examiner* — Christopher Verdier
(74) *Attorney, Agent, or Firm* — Norton Rose Fulbright Canada LLP

(57) ABSTRACT

A seal housing is provided to substantially cover at least one duct wall of vane array duct of a gas turbine engine, and one example arrangement is employed in a mid-turbine frame. The arrangement provides improved sealing of the vane array duct through the provision of a plurality of cavities extending along the duct wall. The arrangement may also include insulation tubes to assist in sealing around load transfer spokes passing through the vane array.

15 Claims, 6 Drawing Sheets

SEALING FOR VANE SEGMENTS

TECHNICAL FIELD

The described subject matter relates generally to gas turbine engines and more particularly, to an arrangement for vane segments of gas turbine engines.

BACKGROUND OF THE ART

A gas turbine engine includes typically a segmented vane ring configured with outer and inner annular duct walls connected by a plurality of airfoils. The circumferential gaps between the segments usually are sealed by feather seals, but may still be a source of cooling air leakage into the hot gas path and/or hot gas ingestion from the hot gas path, if these circumferential gaps between the segments are not adequately sealed. Thus, there is room for improvement.

Accordingly, there is a need to provide an improved vane arrangement.

SUMMARY

In one aspect, the described subject matter provides a gas turbine engine comprising a segmented vane array disposed radially between annular outer and inner engine cases and including a segmented annular outer duct wall, a segmented annular inner duct wall, and a plurality of hollow airfoils radially extending between the outer and inner duct walls, a plurality of seals extending between adjacent segments on the inner and outer duct walls to thereby provide a gas path between the inner and outer duct walls, the gas path extending in an axial direction; and an annular seal housing extending axially substantially along an entire axial length of one of the duct walls, the seal housing spaced apart from said duct wall and from an adjacent one of the inner and outer engine cases to thereby provide an annular case cavity between said case and the seal housing and an annular duct cavity between the seal housing and said duct wall, the case cavity in fluid communication with an engine source of pressurized cooling air, the seal housing sealingly mounted within the engine to in use permit said cooling air to provide a pressure differential in the case cavity relative to the duct cavity.

In another aspect, the described subject matter provides a gas turbine engine comprising a mid turbine frame (MTF) disposed axially between first and second turbine rotors, the MTF including an annular outer engine case, an annular inner engine case and a plurality of load spokes radially extending between and interconnecting the outer and inner engine cases to transfer loads from the inner engine case to the outer engine case; an annular inter-turbine duct (ITD) disposed radially between the outer and inner engine case of the MTF, the ITD including an annular outer duct wall and annular inner duct wall, thereby defining an annular hot gas path between the outer and inner duct walls for directing hot gases from the first turbine rotor to the second turbine rotor, a plurality of hollow struts radially extending between and interconnecting the outer and inner duct walls, the load spokes radially extending through at least a number of the hollow struts, the ITD being assembled from a plurality of circumferential duct wall segments, each having at least one strut interconnecting a circumferential section of the outer duct wall and a circumferential section of the inner duct wall; a first annular case cavity defined between the annular outer engine case and outer duct wall and a second annular case cavity defined between the annular inner duct wall and inner engine case, the first and second case cavities being in fluid communication with an inner space within the respective hollow struts; and an air sealing system for the first and second case cavities and the hollow struts against cooling air leakage through gaps between the circumferential segments of the ITD, the system including an annular first seal housing disposed in the first annular case cavity and extending axially along a substantial length of the outer duct wall; an annular second seal housing disposed in the second annular case cavity and extending axially along a substantial length of the inner duct wall, the first and second seal housings having a plurality of openings to allow the respective load spokes to radially extend therethrough; and a plurality of insulation tubes aligning with the openings in the respective first and second seal housings, to surround the respective load spokes and to be attached to the first and second seal housings.

Further details of these and other aspects of the described subject matter will be apparent from the detailed description and drawings included below.

DESCRIPTION OF THE DRAWINGS

Reference is now made to the accompanying drawings depicting aspects of the described subject matter, in which.

DETAILED DESCRIPTION

Figure 1:
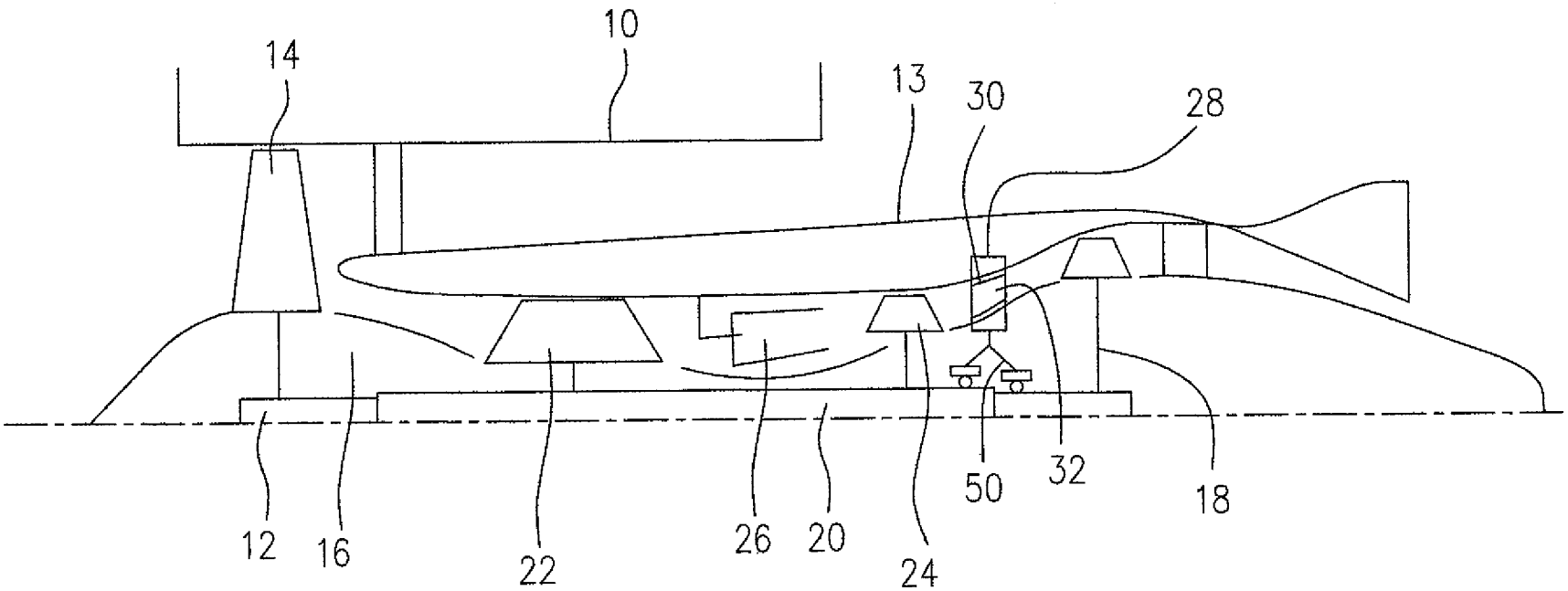
FIG. 1 is a schematic cross-sectional view of a turbofan gas turbine engine according to the present description.

Referring to FIG. 1, a bypass gas turbine engine includes a fan case 10, a core casing 13, a low pressure spool assembly which includes a fan assembly 14, a low pressure compressor assembly 16 and a low pressure turbine assembly 18 connected by a shaft 12 and a high pressure spool assembly which includes a high pressure compressor assembly 22 and a high pressure turbine assembly 24 connected by a turbine shaft 20. The core casing 13 surrounds the low and high pressure spool assemblies to define a main fluid path therethrough. In the main fluid path there is provided a combustor 26 which generates combustion gases to power the high pressure turbine assembly 24 and the low pressure turbine assembly 18. A mid turbine frame (MTF) 28 is provided between the high pressure turbine assembly 24 and the low pressure turbine assembly 16 and includes a bearing housing 50 to support bearings around the respective shafts 20 and 12. The mid turbine frame 28 includes an inter-turbine duct (ITD) 30 to define an annular hot gas path 32 for directing hot gases from the high pressure turbine assembly 24 to pass into the low pressure turbine assembly 18.

Figure 2:
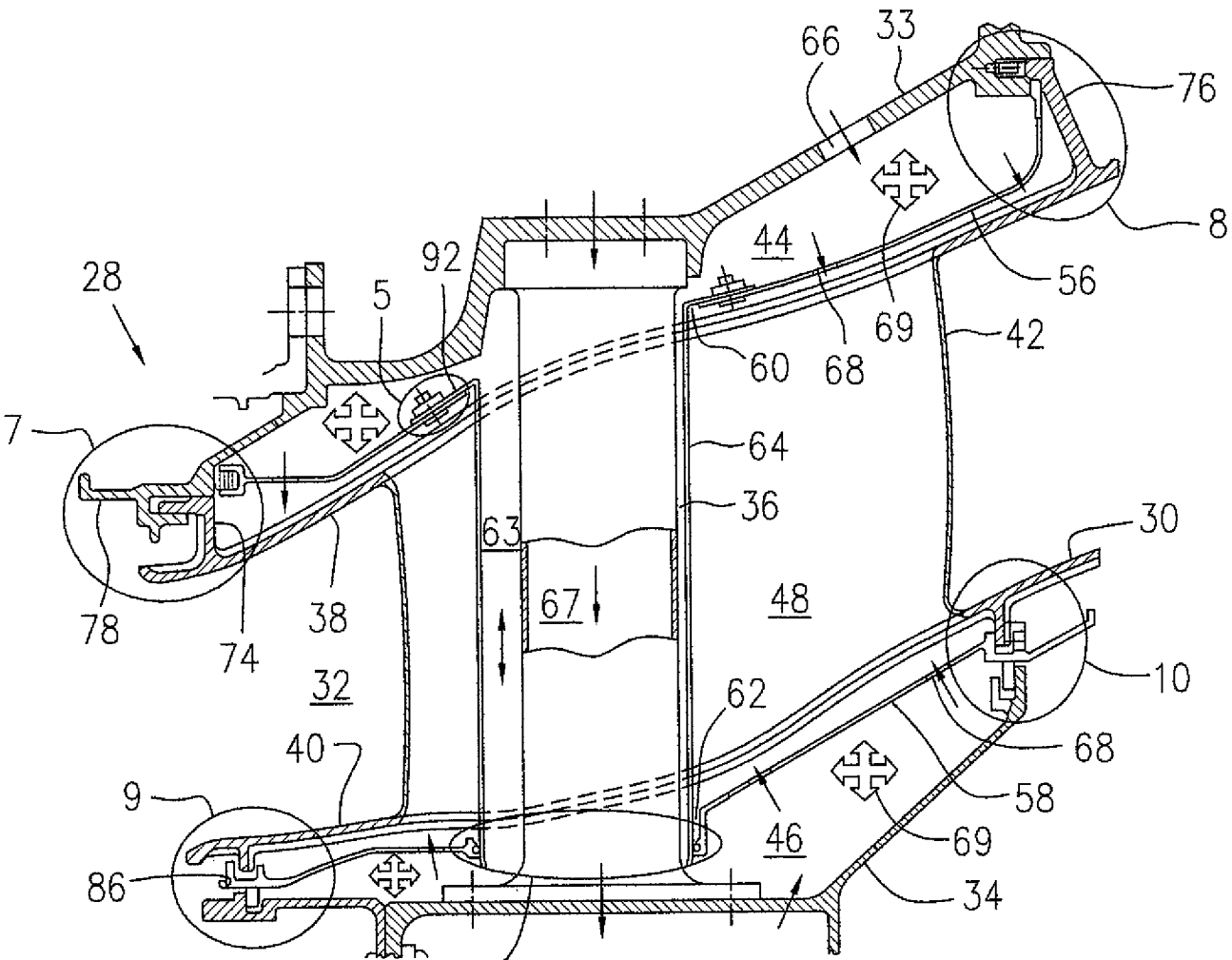
FIG. 2 is a partially cut away cross-sectional view of a mid turbine frame having an air sealing system according to one embodiment.
Figure 3:
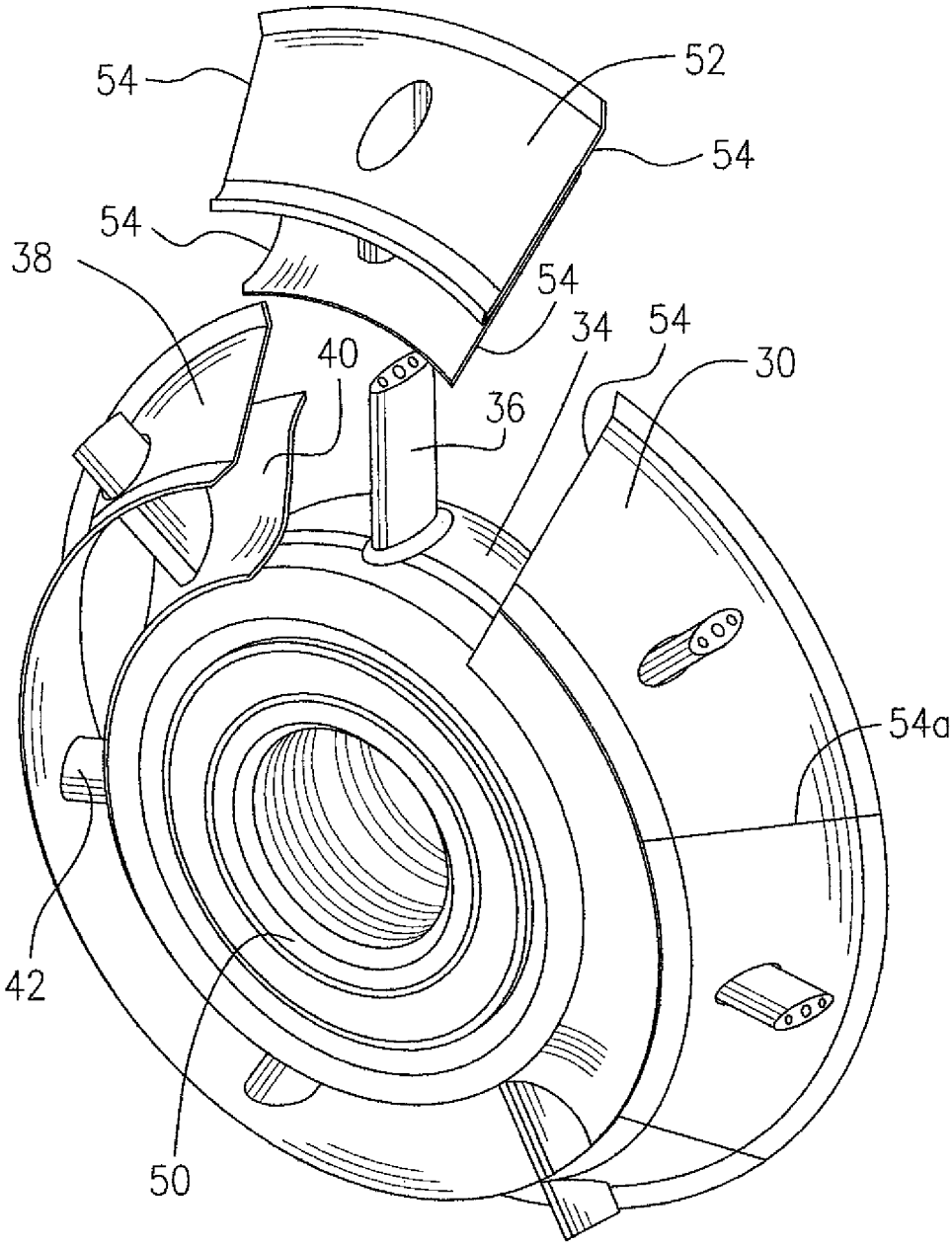
FIG. 3 is a partially exploded perspective view of the mid turbine frame of FIG. 2, showing circumferential segments of a segmented inter-turbine duct to be installed in the mid turbine frame.

Referring to FIGS. 1-3, the mid turbine frame 28 includes an annular outer engine case 33 which has mounting flanges (not numbered) at both ends for connection to other components which cooperate to provide the core casing 13 of the engine. The outer engine case 33 may thus be a part of the core casing 13. An annular inner engine case 34 is coaxially disposed within the outer engine case 33 and a plurality of (at least three) load spokes 36 radially extend between the outer engine case 33 and the inner engine case 34. The inner engine case 34 is coaxially connected to a bearing housing 50 (see FIG. 1) which supports the bearings.

The load spokes 36 are each affixed at an inner end thereof to the inner engine case 34, for example by welding. The load spokes 36 may be either solid or hollow. Each of the load spokes 36 is connected at an outer end thereof to the outer engine case 33, for example by a plurality of fasteners (not shown). Therefore, the load spokes radially extend between and interconnect the outer and inner engine cases 33, 34 to transfer the loads from the bearing housing 50 and the inner engine case 34 to the outer engine case 33.

The annular ITD 30 is disposed radially between the outer engine case 33 and the inner engine case 34 of the MTF 28. The ITD 30 includes an annular outer duct wall 38 and an annular inner duct wall 40, thereby defining the annular hot gas path 32 between the outer and inner duct walls 38, 40 for directing hot gases to pass therethrough. A plurality of hollow struts 42 (also referred to as airfoils) which are in an aerodynamic profile, radially extend between and interconnect the outer and inner duct walls 38 and 40. Each of the hollow struts 42 defines an inner space 48. The load spokes 36 radially extend through the respective hollow struts 42, or at least through a number of the hollow struts (when the number of load spokes 36 is less than the number of hollow struts 42).

The MTF 28 therefore defines a first annular cavity 44 between the annular outer engine case 33 and the annular outer duct wall 38 and a second annular cavity 46 between the annular inner duct wall 40 and the annular inner engine case 34. The annular first and second cavities 44 and 46 are in fluid communication with the inner space 48 in the respective hollow struts 42.

The ITD 30 is a segmented configuration which is assembled from a plurality of circumferential duct wall segments 52. Each duct wall segment 52 has at least one strut 42 which interconnects a circumferential section of the outer duct wall 38 and a circumferential section of the inner duct wall 40. The circumferential section of the respective outer and inner duct walls 38, 40 has circumferentially opposed side edges 54. A circumferential gap 54*a* is defined between the adjacent side edges 54 of adjacent duct wall segments 52 when the ITD 30 is assembled.

A first annular seal housing 56, which may be, for example, a monolithic ring of sheet metal, is disposed in the first annular cavity 44 and extends axially along a substantial length of the outer duct wall 38 to form a heat shield for protecting the outer engine case 33 from heat radiating from the hot gas path 32. Therefore, the first seal housing 56 divides the first cavity 44 into an annular case cavity between the outer engine case 33 and the first seal housing 56 and a duct cavity between the first seal housing 56 and the outer duct wall 38. A second annular seal housing 58, which may be, for example, a monolithic ring of sheet metal, is disposed in the second annular cavity 46 and extends axially along a substantial length of the inner duct wall 40 to form a heat shield for protecting the inner engine case 34 from heat radiating from the hot gas path 32. Therefore, the second seal housing 58 divides the second cavity 46 into a case cavity between inner engine case 34 and the second seal housing 58 and an annular duct cavity between the second seal housing 58 and the inner duct wall 40. The first and second seal housings have in this example a plurality of openings 60, 62 to allow the respective load spokes 36 to radially extend therethrough.

Optionally, a plurality of insulation tubes 64, which may be made for example from sheet metal, are aligned with the openings 60, 62 defined in the respective first and second seal housings 56, 58. Each of the insulation tubes 64 surrounds one of the load spokes 36 and are attached to the first and second seal housings 56, 58.

If the number of load spokes 36 is less than the number of hollow struts 42, the hollow struts 42 which do not have load spokes 36 extending therethrough, may be completely covered at the opposed ends thereof by the respective first and second seal housings 56, 58 without corresponding openings 60, 62 at those particular locations. Therefore, there is no insulation tube 64 to be provided within such hollow spokes. Alternatively, insulation tubes 64 may be provided in every hollow spoke 42 aligning with corresponding openings 60, 62 defined in the respective first and second seal housing 56, 58, regardless of whether or not a load spoke 36 extends through a particular hollow strut 42.

The first and second seal housings 56, 58 are installed in the respective first and second cavities 44, 46 with a plurality of annular seals which will be further described hereinafter, in order to form an air sealing system (not numbered) for the first and second cavities 44 and 46 and the hollow struts 42 against cooling air leakages through the gaps 54*a* (see FIG. 3) between the circumferential duct wall segments 52 of the ITD 30. The gaps 54*a* are formed between the adjacent side edges 54 of the adjacent ITD duct wall segments 52 in each of the outer and inner duct walls 38 and 40. The cooling air leakage through the gaps between the segments of the ITD 30 will be further described with reference to FIG. 4 below. The first and second seal housings 56, 58 in combination with the insulation tubes 64, substantially isolate the axial gaps 54*a* in the respective outer and inner duct walls 38, 40, from the first and second cavities 44, 46 and the inner space 48 of the respective hollow struts.

In one embodiment, the outer engine case 33 may define a cooling air inlet 66 in fluid communication through an external passage (not shown) with a pressurized cooling air source. Therefore, cooling air may be introduced from inlet 66 to enter the second cavity 46 through respective annulus 63 between the insulation tube 64 and the load spokes 36. The sealing system formed by the first and second seal housings 56, 58 with insulation tubes 64, maintains the first and second cavities 44, 46 substantially pressurized with the cooling air introduced from the inlet 66. Hollow cross arrows 69 indicate the pressurized state in the first and second cavities 44 and 46.

Alternative to the arrangement of introducing cooling air into the first cavity 44, the inlet 66 defined in the outer engine case 33 may be positioned to align with one or more load spokes 36 which are hollow and define a radial passage 67 such that cooling air may be introduced radially and inwardly through the radial passage 67 into the inner engine case 34 which is in fluid communication with the second cavity 46. Therefore, the cooling air in the second cavity 46 enters the first cavity 44 through the respective annulus 63 between the insulation tube 64 and the load spoke 36. Similarly, the first and second cavities 44 and 46 are pressurized with the cooling air.

Optionally, the first and second seal housings 56, 58 may be spaced apart from the respective outer and inner duct walls 38, 40 and a plurality of holes 68 (see FIG. 11) may be provided in the respective first and second seal housings 56, 58, at least some of the holes 68 aligning with the duct wall segments such that air streams under the air pressure indicated by arrows 69, eject from the holes 68, resulting in impingement cooling on the respective outer and inner duct walls 38, 40.

Optionally, feather seals 70 may be provided on the respective outer and inner duct walls 56, 58 to cover the gaps 54*a* between the circumferential duct wall segments 52 of the ITD 30. At least some of the holes 68 defined in the respective first and second seal housings 56, 58 may be positioned to align with the respective gaps 54*a*/seals 70 between the circumferential duct wall segments 52 of the ITD 30 for directing cooling air streams directly upon the feather seals 70 against the respective outer and inner duct walls 38, 40 in order to cool the seals 70 and to avoid hot gas ingestion from the gaps 54*a*.

The feather seals 70 which cover the individual gaps 54*a* between the circumferential duct wall segments 52 in either of the outer and inner duct walls 38, 40 of the ITD 30, may be formed as a single annular seal, for example by a plurality of feather components circumferentially extending between and interconnecting adjacent feather seals 70.

Figure 4:
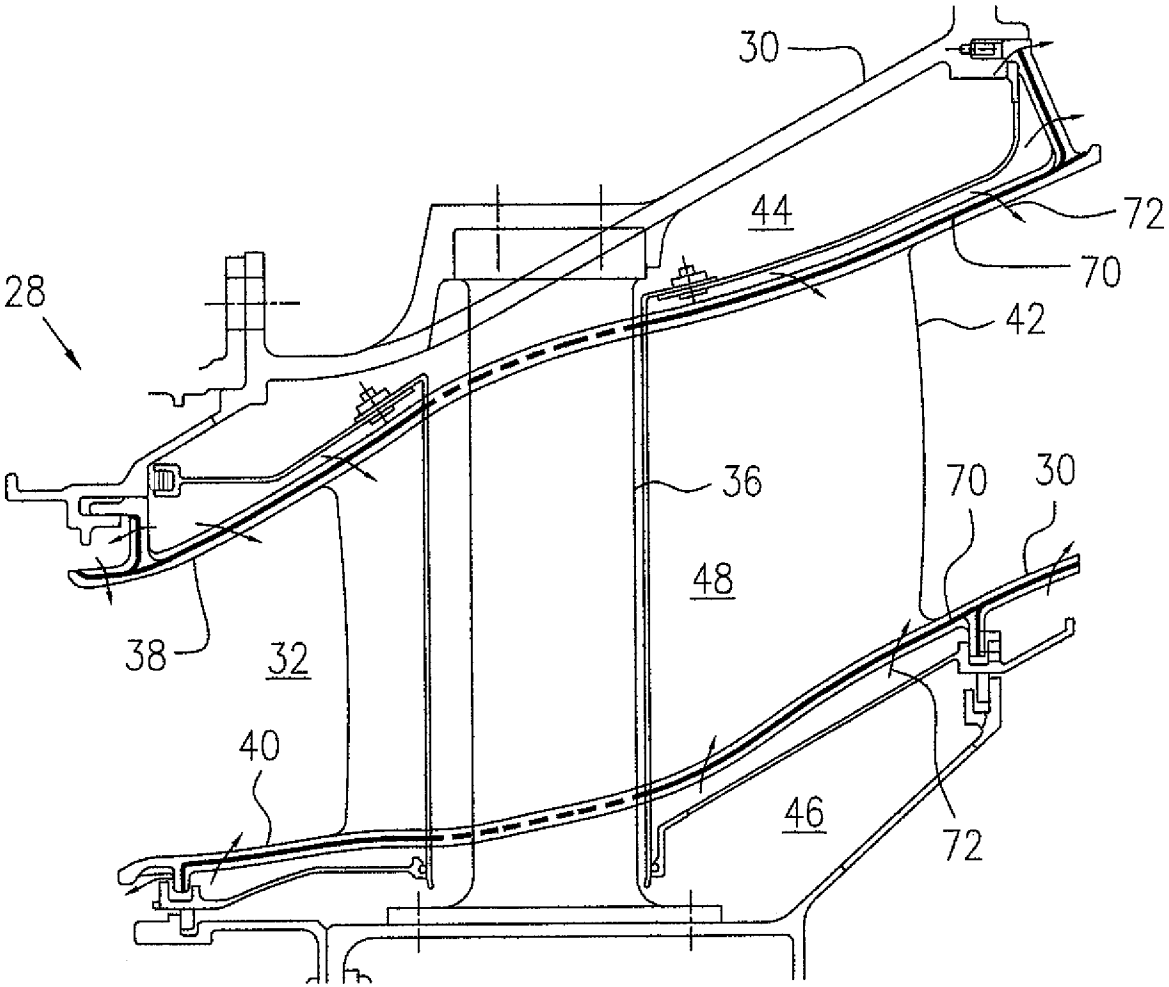
FIG. 4 is a somewhat schematic cross-sectional view of the mid turbine frame system similar to that of FIG. 2.
Figure 12:
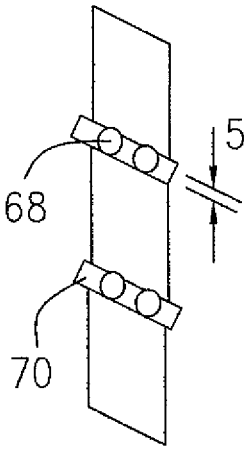
FIG. 12 is a view similar to FIG. 11 showing another position for holes defined in the seal housings (not shown).
Figure 11:
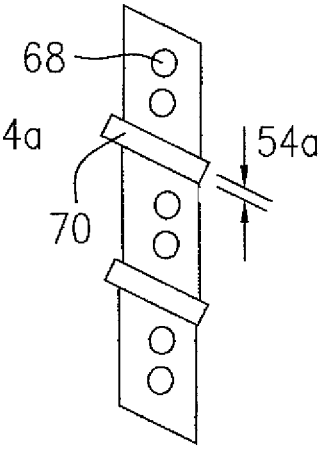
FIG. 11 is a schematic top view illustration of a circumferential portion of the segmented inter-turbine duct of FIG. 3, showing a position of holes defined in the seal housings (not shown)

As shown in FIG. 4, arrows 72 indicate the air leakage from the first and second cavities 44, 46 through the gaps 54*a* (see FIGS. 3, 11 and 12) between the segments of the ITD 30. The feather seals 70 may be placed on the respective outer and inner duct walls 38, 40, to cover the respective gaps 54*a* (see FIGS. 3, 11 and 12) in order to prevent or minimize air leakage 72, which is also shown in FIGS. 11 and 12.

Referring to FIGS. 1-2 and 7-8, the annular outer duct wall 38 may include front and rear hooks 74 and 76 at opposed axial ends thereof for connection with the annular outer engine case 33. Therefore, the first cavity 44 is also defined axially between the front and rear hooks 74 and 76. The annular front and rear hooks 74, 76 may be positioned as far as possible to the respective front and rear axial ends of the annular outer duct wall 38 in order to allow the first cavity 44 to extend along the substantial axial length of the outer duct wall 38. According to one embodiment, the annular outer engine case 33 may be integrated with a rear housing 78 of the high pressure turbine assembly 24 in order to allow the front hook 74 of the outer duct wall 38 to be positioned further upstream.

Figure 8:
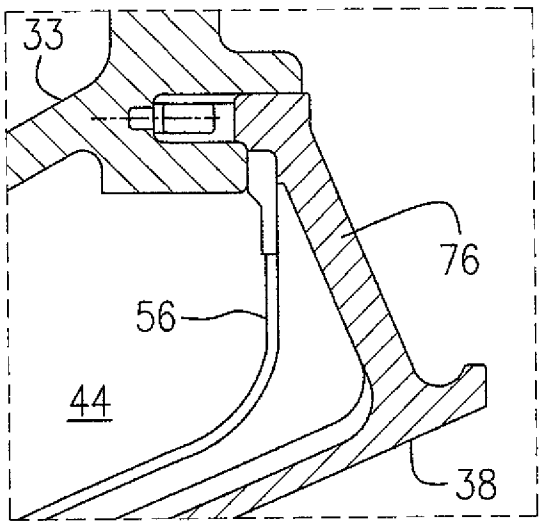
FIG. 8 illustrates a circled area 8 of FIG. 2 in an enlarged scale, showing an axial retention of the outer engine case and the first seal housing at an axial rear end of the outer engine case.

An annular front end 80 (see FIG. 7) of the annular first seal housing 56 is positioned adjacent a radial surface (not numbered) of the outer engine case 33 at the axial front end thereof. A seal device, such as a "W" seal 82 may be provided between the radial surface of the outer engine case 33 and the axial front end 80 of the first seal housing 56. The rear book 76 of the annular outer duct wall 38 as shown in FIG. 8, in combination with a low turbine module (not shown) of the low pressure turbine assembly 18 (see FIG. 1) provides an axial retention of the ITD 30 and the sealing of the first cavity 44.

Figure 9:
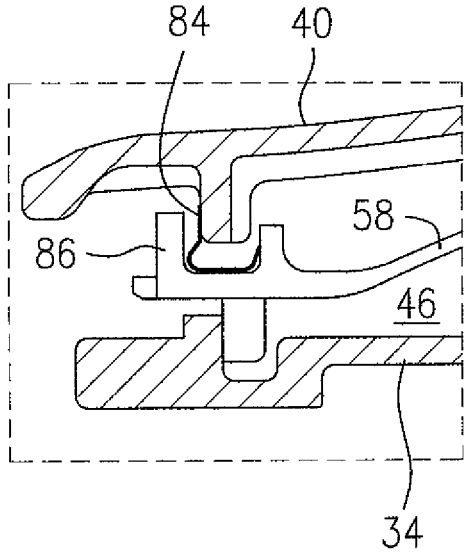
FIG. 9 illustrates a circled area 9 of FIG. 2 in an enlarged scale, showing a resilient element included in a seal between the axial front ends of the respective inner duct wall and the second seal housing.

Referring to FIGS. 1-2 and 9, a seal device such as a crush seal 84 which includes a resilient component, is provided between an axial front end 86 of the second seal housing 58 and an axial front end (not numbered) of the annular inner duct wall 40 to allow an axial expansion of the inner duct wall 40 with respect to the second seal housing 58. The axial front end 86 of the second seal housing 58 is also sealingly connected with an axial front end (not numbered) of the inner engine case 34, thereby sealing the second cavity 46.

Figure 10:
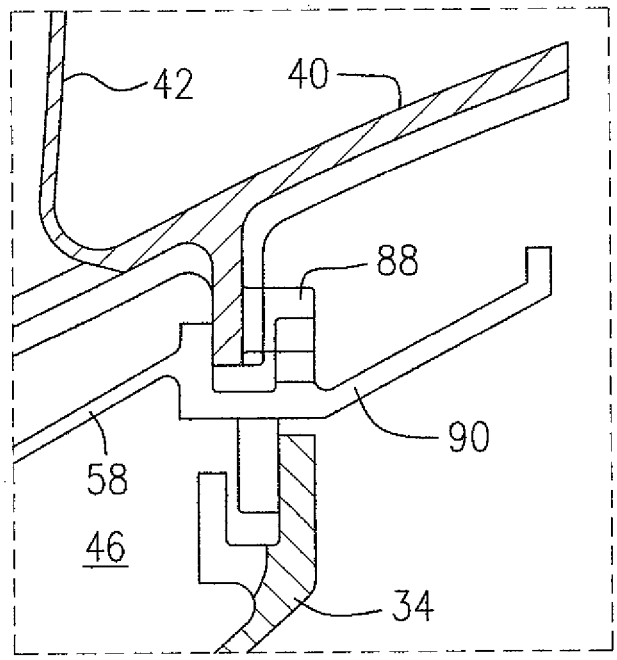
FIG. 10 illustrates a circled area 10 of FIG. 2 in an enlarged scale, showing a thermal expansion joint to position an axial rear end of the second seal housing.

Referring to FIGS. 1-2 and 10, an annular seal 88 which may include a thermal expansion joint, is positioned between an axial rear end 90 of the second seal housing 58 and an axial rear end (not numbered) of the annular inner duct wall 40, in order to allow radial expansion of the inner duct wall 40 with respect to the second seal housing 58. The axial rear end 90 of the second seal housing 58 is also sealingly connected with an axial rear end (not numbered) of the inner engine case 34, thereby sealing the second cavity 46.

Figure 5:
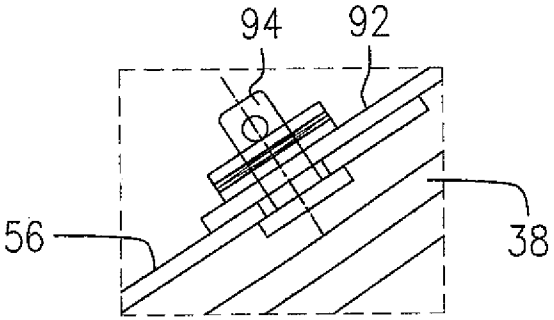
FIG. 5 illustrates a circled area 5 of FIG. 2 in an enlarged scale, showing the attachment of a flange of an insulation tube with a first annular seal housing of the air scaling system.

Referring to FIGS. 2 and 5, each of the insulation tubes 64 includes a flange 92 integrally and outwardly extending from a radial outer end (not numbered) of the insulation tube 64. The flange 92 of the insulation tube 64 overlaps a peripheral edge (not numbered) of the opening 60 which receives the insulation tube 64, defined in the first seal housing 56. The overlapped flange 92 of the insulation tube 64 is secured to the first seal housing 56 by a fastener 94 which, for example is a pin-typical spring washer as shown in FIG. 5.

Figure 6:
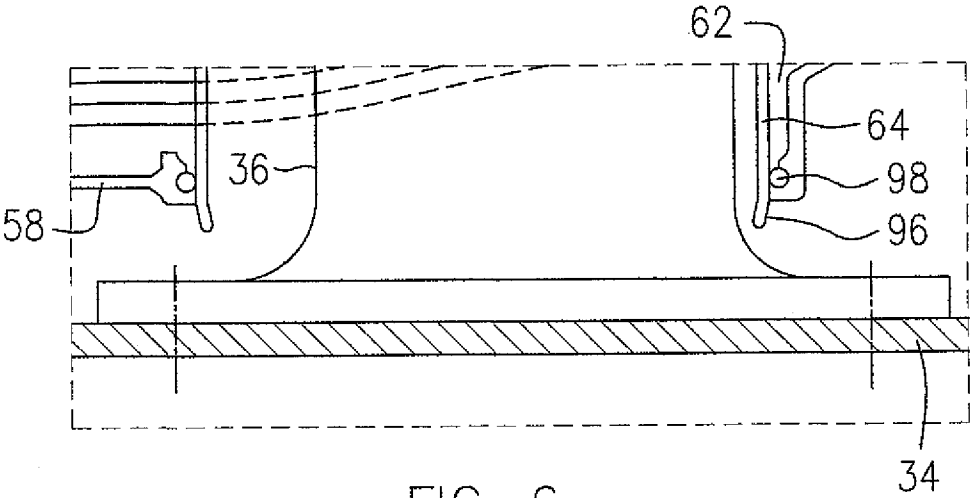
FIG. 6 illustrates a circled area 6 of FIG. 2 in an enlarged scale, showing the attachment of the insulation tube with a second annular seal housing of the air sealing system.
Figure 7:
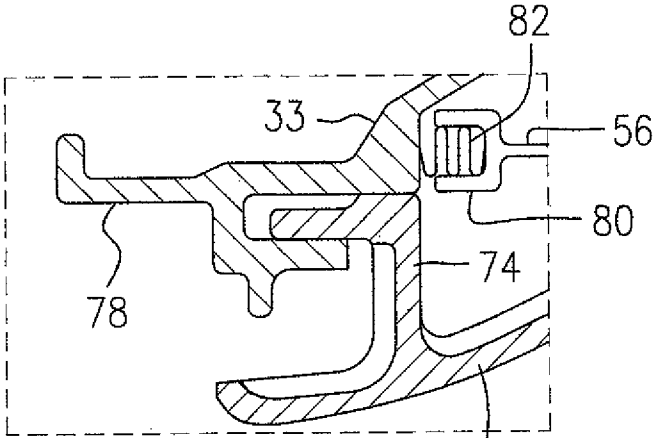
FIG. 7 illustrates a circled area 7 of FIG. 2 in an enlarged scale, showing a seal disposed between an outer engine case and the first seal housing of the air sealing system.

Referring to FIGS. 2 and 6, the insulation tube 64 includes a radial inner end 96 which is inserted into a corresponding opening 62 defined in the second seal housing 58. An annular seal 98 such as a compliance seal of any suitable type may be provided to make the seal between the radial inner end 96 of the insulation tube 64 and the second seal housing 58.

The above description is meant to be exemplary only, and one skilled in the art will recognize that changes may be made to the embodiments described without departure from the scope of the present description. For example, the approach may be applied to any suitable vane configuration in the engine. The described subject matter may be applied to any suitable gas turbine engines type. Any suitable sealing arrangement may be employed. Still other modifications which fall within the scope of the present description will be apparent to those skilled in the art, in light of a review of this disclosure, and such modifications are intended to fall within the appended claims.

The invention claimed is:

1. A gas turbine engine comprising:

a segmented vane array disposed radially between annular outer and inner engine cases and including a segmented annular outer duct wall, a segmented annular inner duct wall, and a plurality of hollow airfoils radially extending between the outer and inner duct walls, a plurality of seals extending between adjacent segments on the inner and outer duct walls to thereby provide a gas path between the inner and outer duct walls, the gas path extending in an axial direction;

an annular seal housing adjacent to one of the inner and outer walls and extending axially substantially along an entire axial length of said adjacent one of the duct walls, the seal housing spaced apart from said adjacent one of the duct walls and from an adjacent one of the inner and outer engine cases to thereby provide an annular case cavity between said adjacent one of the cases and the seal housing and an annular duct cavity between the seal housing and said adjacent one of the duct walls, the case cavity in fluid communication with an engine source of pressurized cooling air, the seal housing sealingly mounted within the engine to in use permit said cooling air to provide a pressure differential in the case cavity relative to the duct cavity; and wherein the inner and outer engine cases have a plurality of load spokes extending radially therebetween through the airfoils, and wherein the seal housing has openings to allow the respective load spokes to radially extend through the seal housing, and wherein the seal housing has a sealing apparatus at each opening to seal between the case cavity and the duct cavity; the sealing apparatus including a plurality of insulation tubes disposed around respective load spokes and extending through the airfoils, the tubes aligning with the openings in the seal housing and attached to the seal housing.

2. The gas turbine engine as defined in claim 1, wherein two said seal housings are provided, a first one between the outer engine case and the outer duct wall, and a second one between the inner engine case and the inner duct wall.

3. The gas turbine engine as defined in claim 2, wherein the seal housings are monolithically ring-shaped.

4. The gas turbine engine as defined in claim 1 wherein the case cavity communicates with a source of pressurized cooling air through a load spoke control radial passage.

5. The gas turbine engine as defined in claim 1 further comprising a plurality of holes in the seal housing for directing cooling air from the case cavity into the duct cavity.

6. The gas turbine engine as defined in claim 5 wherein at least some of the holes are disposed to align with the plurality of seals between the duct wall segments.

7. The gas turbine engine as defined in claim 5 wherein at least some of the holes are disposed to align with and cool the duct wall segments.

8. A gas turbine engine comprising:

a mid turbine frame (MTF) disposed axially between first and second turbine rotors, the MTF including an annular outer engine case, an annular inner engine case and a plurality of load spokes radially extending between and interconnecting the outer and inner engine cases to transfer loads from the inner engine case to the outer engine case;

an annular inter-turbine duct (ITD) disposed radially between the outer and inner engine case of the MTF, the ITD including an annular outer duct wall and annular inner duct wall, thereby defining an annular hot gas path between the outer and inner duct walls for directing hot gases from the first turbine rotor to the second turbine rotor, a plurality of hollow struts radially extending between and interconnecting the outer and inner duct walls, the load spokes radially extending through at least a number of the hollow struts, the ITD being assembled from a plurality of circumferential duct wall segments, each having at least one strut interconnecting a circumferential section of the outer duct wall and a circumferential section of the inner duct wall;

a first annular case cavity defined between the annular outer engine case and outer duct wall and a second annular case cavity defined between the annular inner duct wall and inner engine case, the first and second case cavities being in fluid communication with an inner space within the respective hollow struts; and an air sealing system for the first and second case cavities and the hollow struts against cooling air leakage through gaps between the circumferential segments of the ITD, the system including:

an annular first seal housing disposed in the first annular case cavity and extending axially along a substantial length of the outer duct wall;

an annular second seal housing disposed in the second annular case cavity and extending axially along a substantial length of the inner duct wall, the first and second seal housings having a plurality of openings to allow the respective load spokes to radially extend therethrough; and a plurality of insulation tubes aligning with the openings in the respective first and second seal housings, to surround the respective load spokes and to be attached to the first and second seal housings.

9. The gas turbine engine as defined in claim 8 wherein a source of pressurized cooling air communicates with the second case cavity through a load spoke central radial passage.

10. The gas turbine engine as defined in claim 8 further comprising a plurality of holes in the seal housings for directing cooling air from the case cavities to the respective outer and inner duct walls.

11. The gas turbine engine as defined in claim 10 wherein at least some of the holes are disposed to align with a plurality of seals between the duct wall segments.

12. The gas turbine engine as defined in claim 10 wherein at least some of the holes are disposed to align with and cool the duct wall segments.

13. The gas turbine engine as defined in claim 8 wherein each of the insulation tubes further comprises a flange extending laterally from an end of the tube, the flange being positioned and sized to overlap a peripheral edge of said opening in the seal housing.

14. The gas turbine engine as defined in claim 8 wherein the inner seal housing is sealingly mounted to the inner duct wall, and wherein the outer seal housing is sealingly mounted to the outer engine case.

15. The gas turbine engine as defined in claim 14 wherein the annular outer duct wall comprises front and rear hooks at opposed axial ends for connection with the annular outer engine case, the outer duct wall and annular outer engine case thereby defining the first case cavity axially positioned between the front and rear hooks.

* * * * *